US009427618B2

(12) United States Patent
Morway

(10) Patent No.: US 9,427,618 B2
(45) Date of Patent: Aug. 30, 2016

(54) MULTI-FUNCTIONAL BARBELL

(71) Applicant: William Morway, Antioch, IL (US)

(72) Inventor: William Morway, Antioch, IL (US)

( * ) Notice: Subject to any disclaimer, the term of this patent is extended or adjusted under 35 U.S.C. 154(b) by 0 days.

(21) Appl. No.: 14/549,345

(22) Filed: Nov. 20, 2014

(65) Prior Publication Data

US 2015/0141214 A1 May 21, 2015

Related U.S. Application Data

(60) Provisional application No. 61/906,744, filed on Nov. 20, 2013.

(51) Int. Cl.

| | |
|---|---|
| ***A63B 21/072*** | (2006.01) |
| ***A63B 21/075*** | (2006.01) |
| ***A63B 21/02*** | (2006.01) |
| ***A63B 21/05*** | (2006.01) |
| ***A63B 21/00*** | (2006.01) |
| *A63B 21/04* | (2006.01) |
| *A63B 21/06* | (2006.01) |

(52) U.S. Cl.

CPC ..... *A63B 21/0728* (2013.01); *A63B 21/0724* (2013.01); *A63B 21/4035* (2015.10); *A63B 21/4049* (2015.10); *A63B 21/02* (2013.01); *A63B 21/0407* (2013.01); *A63B 21/0428* (2013.01); *A63B 21/0442* (2013.01); *A63B 21/05* (2013.01); *A63B 21/0608* (2013.01)

(58) Field of Classification Search

CPC .. A63B 21/02; A63B 21/023; A63B 21/025; A63B 21/026; A63B 21/04; A63B 21/0407; A63B 21/0428; A63B 21/0435; A63B 21/0442; A63B 21/05; A63B 21/055; A63B 21/0552; A63B 21/0557; A63B 21/0608; A63B 21/072; A63B 21/0722; A63B 21/0724; A63B 21/0726; A63B 21/0728; A63B 21/075; A63B 21/078; A63B 21/0783; A63B 21/4035; A63B 21/4049

USPC ..... 482/92–93, 106–107, 121–122, 126, 482/128, 138–139

See application file for complete search history.

(56) References Cited

U.S. PATENT DOCUMENTS

| | | | | |
|---|---|---|---|---|
| 3,938,803 | A * | 2/1976 | Wilmoth | A63B 21/05 482/127 |
| 4,978,122 | A * | 12/1990 | Dibowski | A63B 21/0724 482/106 |
| 7,086,999 | B2 * | 8/2006 | Jeneve | A63B 21/015 482/106 |
| 2004/0242385 | A1 * | 12/2004 | Emick | A63B 21/0724 482/106 |
| 2006/0105890 | A1 * | 5/2006 | Logue | A63B 21/0724 482/106 |
| 2008/0026920 | A1 * | 1/2008 | Berenshteyn | A63B 21/0724 482/106 |
| 2012/0094812 | A1 * | 4/2012 | Smiley | A63B 21/0004 482/128 |
| 2012/0322630 | A1 * | 12/2012 | Hood | A63B 21/023 482/106 |
| 2014/0087925 | A1 * | 3/2014 | Dupuis | A63B 21/062 482/97 |

* cited by examiner

*Primary Examiner* — Oren Ginsberg
*Assistant Examiner* — Joshua Lee
(74) *Attorney, Agent, or Firm* — The John Marshall Law School Patent Clinic; Vangelis Economou

(57) ABSTRACT

An apparatus includes a weightlifting bar. The apparatus further includes a set of cams each having an opening and a weight loading bar protruding therefrom and being substantially perpendicular to the cam, wherein each of the set of cams is suspending from the weightlifting bar. A linear bearing slidably engages with the weightlifting bar, and the linear bearing is fitted in the opening of the cam. A set of shaft collars secure the linear bearing in a position on the weightlifting bar between the set of shaft collars.

12 Claims, 11 Drawing Sheets

PRIOR ART

PRIOR ART

PRIOR ART

PRIOR ART

MULTI-FUNCTIONAL BARBELL

CROSS-REFERENCE OF RELATED APPLICATIONS

This is a nonprovisional of a provisional patent application, Ser. No. 61/906,744, filed on Nov. 20, 2013. The entire content of the provisional patent application is incorporated by reference in its entirety.

BACKGROUND

Weightlifting exercises and related devices or equipment have been used by individuals for various reasons. These equipment or devices may include barbells, weights, exercise machines, etc. For strength building, many have employed the use of barbells, weights and bench to build upper body muscle mass and strength. For example, FIGS. 1-3 describe just a small sample of exercises, such as back squat, front squat, and bench press, using existing weightlifting bars and weights.

While these appear to have been employed for a long time, there are a number of shortcomings. For example, the weights on the weightlifting bar are not movable. As such, in order to use the same weight and the bar setup to exercise different muscle groups, other than those intended groups, will be unlikely, without serious injury.

Secondly, the existing arrangements of the weights can be challenging for beginners. For example, the weight distribution and balancing can be difficult and unsafe for the beginners.

Others have attempted to modify the existing bar by providing a special contour shaped bar, such as the one shown in FIG. 4. This modified bar, while resolving the balancing problem, creates a new problem by unable to use existing rack to hold the modified bar at the resting position. In addition, the modified bar is a "one-size-fits-all" design that may not be suitable for all users.

SUMMARY

Aspect of the invention overcome the deficiencies of the prior art by providing a multi-functional barbell for weight training purposes with a slidable cam or weight redistribution plate that redistributes the weight lower than previous position on the weightlifting bar. In addition, the multi-functional barbell employs existing weightlifting bar size and measure, so the barbell may be placed on existing rack as well as using the existing weight size for the free weights.

According to embodiments of the invention, the multi-functional barbell includes a "moveable" or "slidable" drop-down cam or weight redistribution plate that hang on the bar that holds the weight plates. In addition, the embodiments of the invention include a shoulder padded structure as an additional attachment, as well as other attachments, to be attached to the bar. For example, the attachment may include a tube with connecting points to the cam along with a spring such that a user may slide the tube along the bar while biasing the spring. This may be helpful in assisting exercises of chest muscles while bench pressing or while the bar is just sitting on the rack that holds the bar. So, now the bar could be used for multiple purposes, without needing additional set of other exercise devices.

DETAILED DESCRIPTIONS

Figure 1:
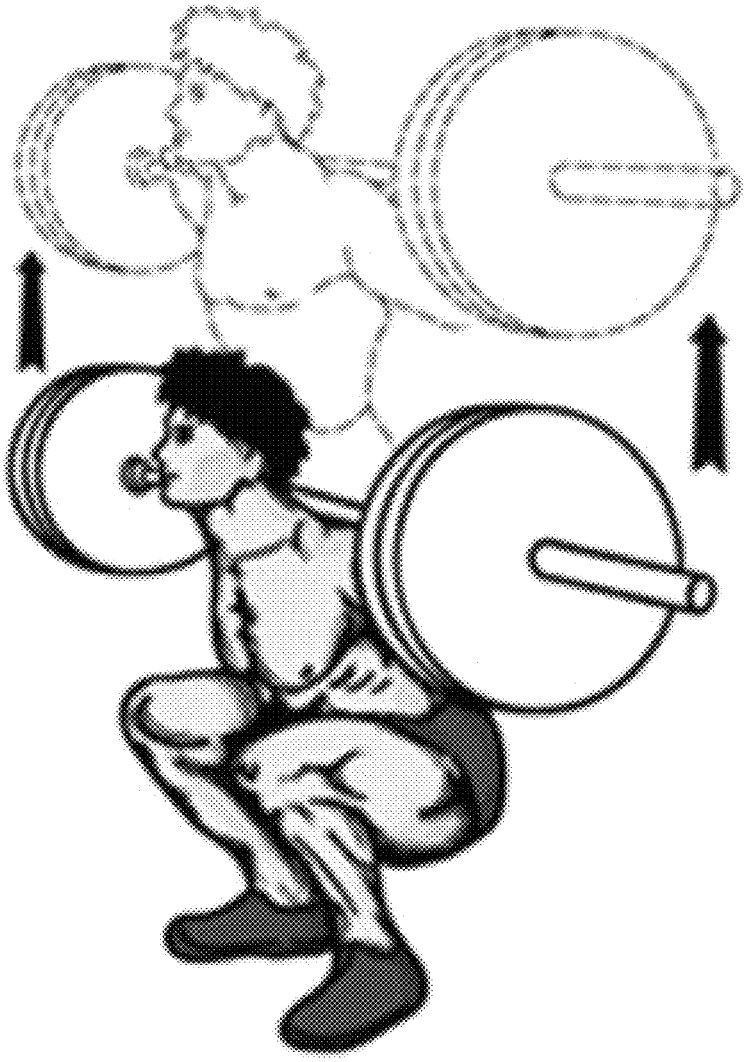
FIGS. 1-4 illustrate prior art of the invention.
Figure 2:
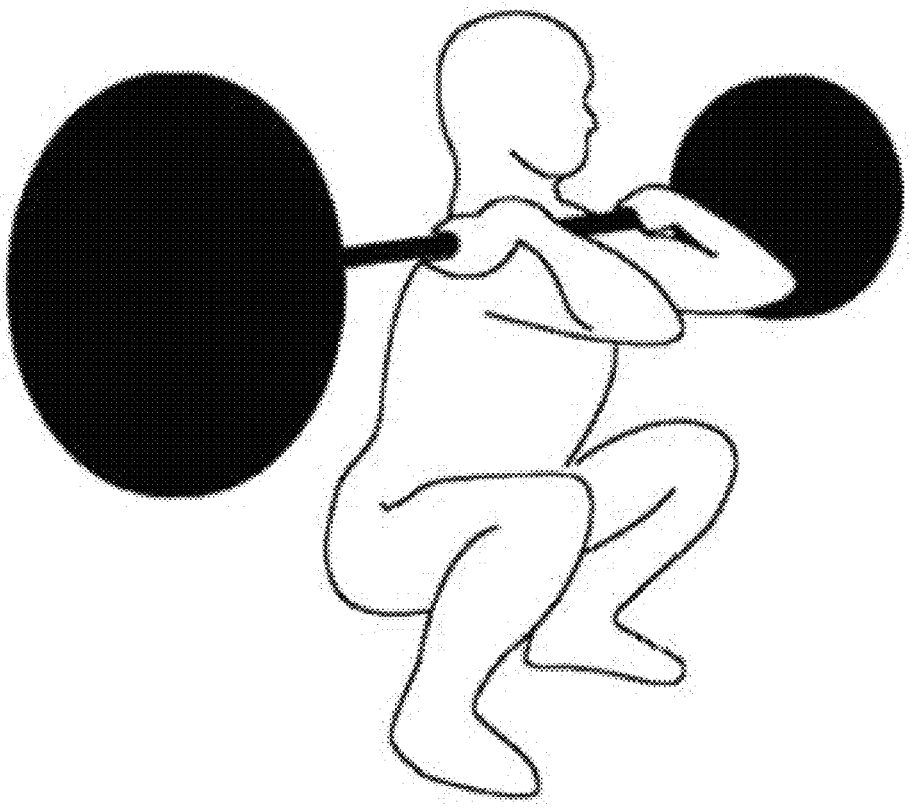
Figure 3:
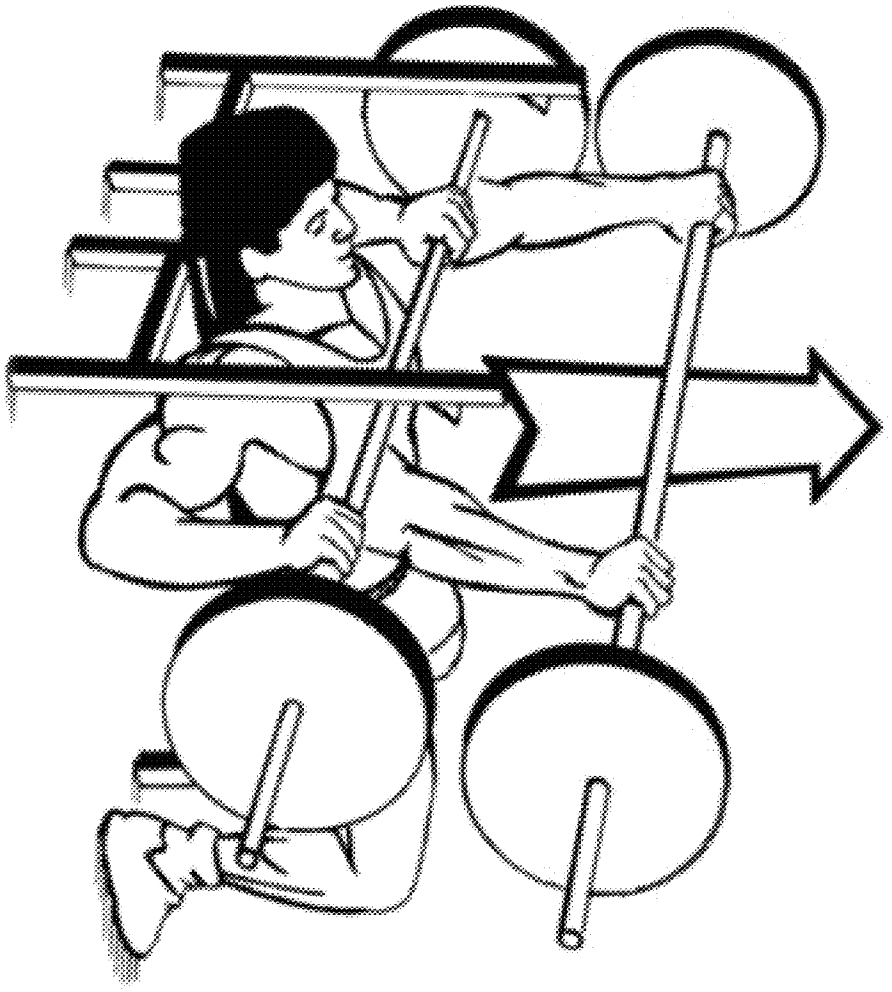
Figure 4:
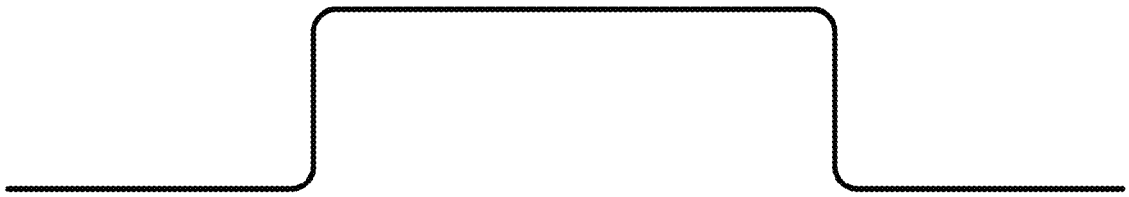
Figure 5:
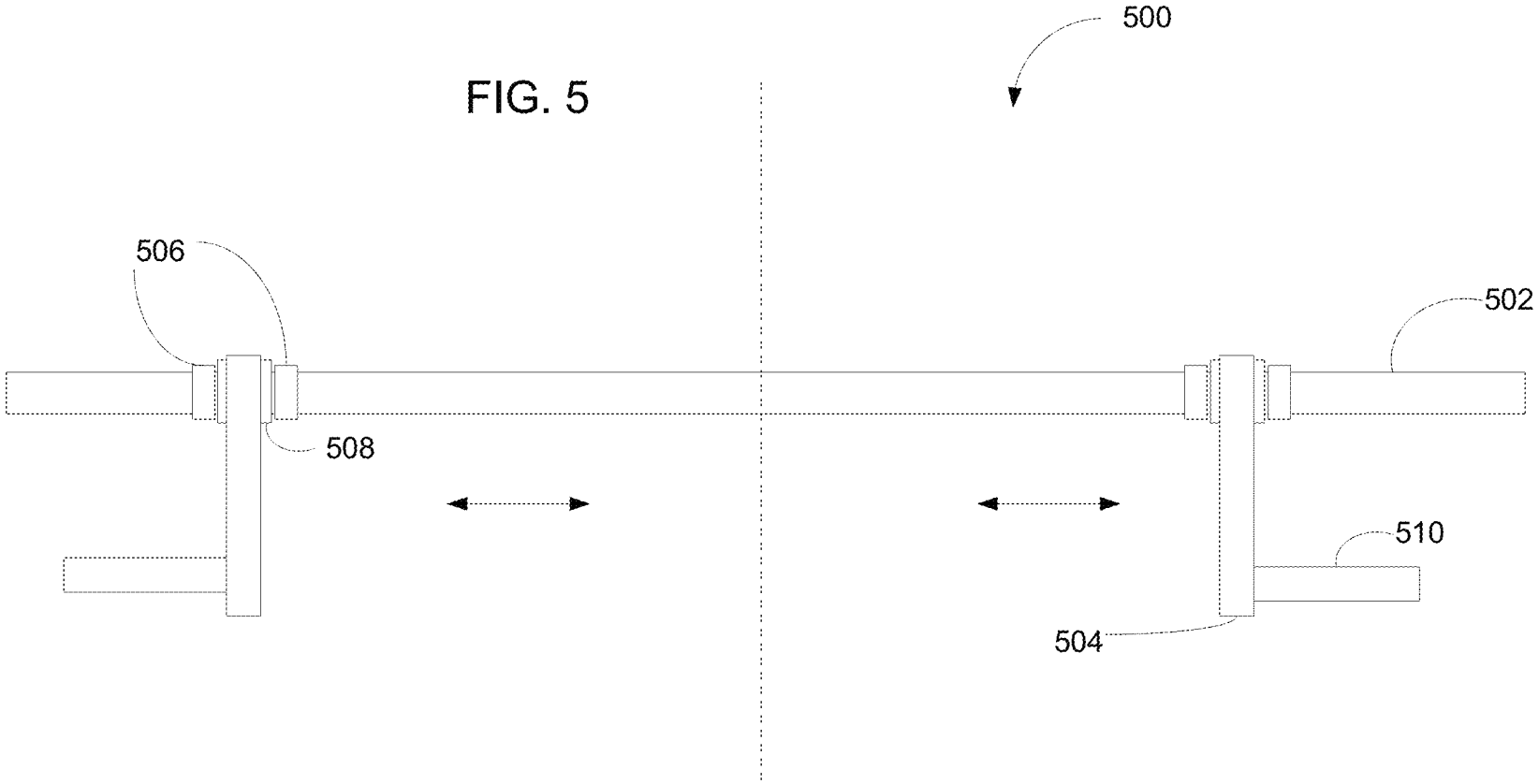
FIG. 5 illustrates a side view of a multi-functional apparatus according to one embodiment of the invention.

Referring now to FIG. 5, a side view of a multi-functional apparatus 500 according to one embodiment of the invention is shown. In this example, the apparatus 500 may be referring to the set of equipment centering around a weightlifting bar 502, a set of cams 504, a set of shaft collars 506, and a linear bearing 508. In another embodiment, the apparatus 500 may refer to a system that includes a weightlifting bar 502, a cam or weight redistribution plate 504, a set of shaft collars 506, and a linear bearing 508. It is to be understood that throughout this document, the apparatus 500 and the system 500 may be used interchangeably without departing from the spirit and the scope of the invention.

Figure 7:
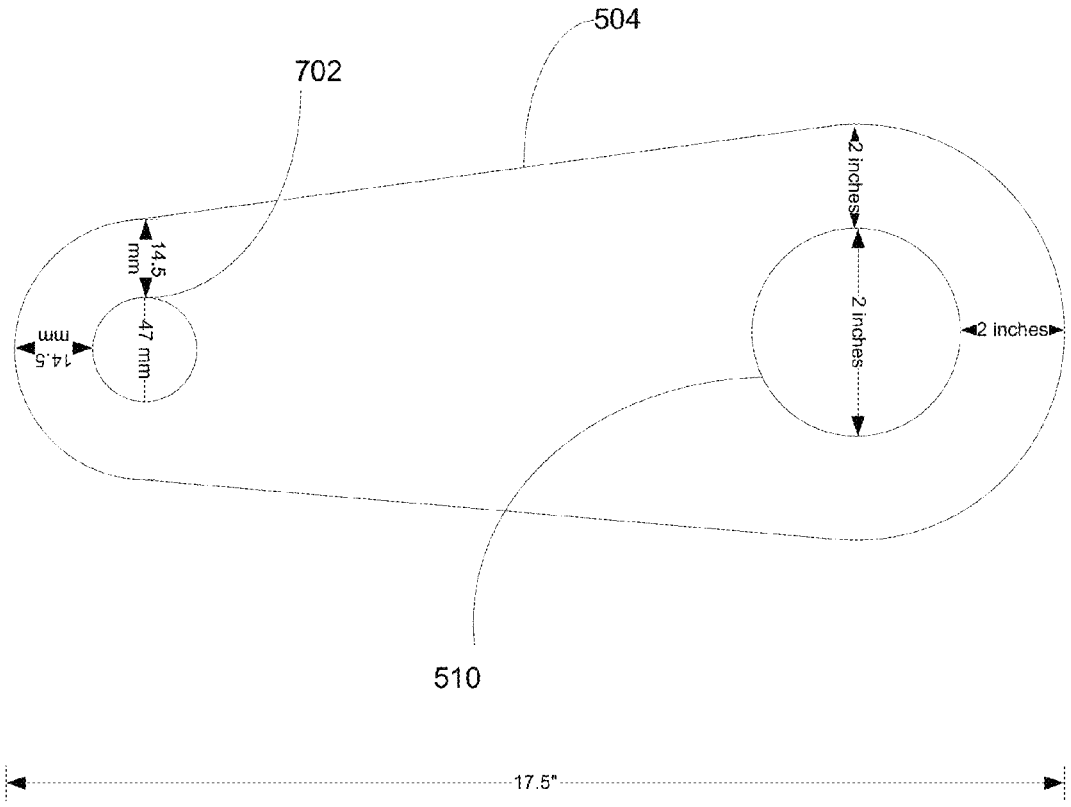
FIG. 7 illustrates a top view of a cam of the multi-functional apparatus according to one embodiment of the invention.
Figure 8:
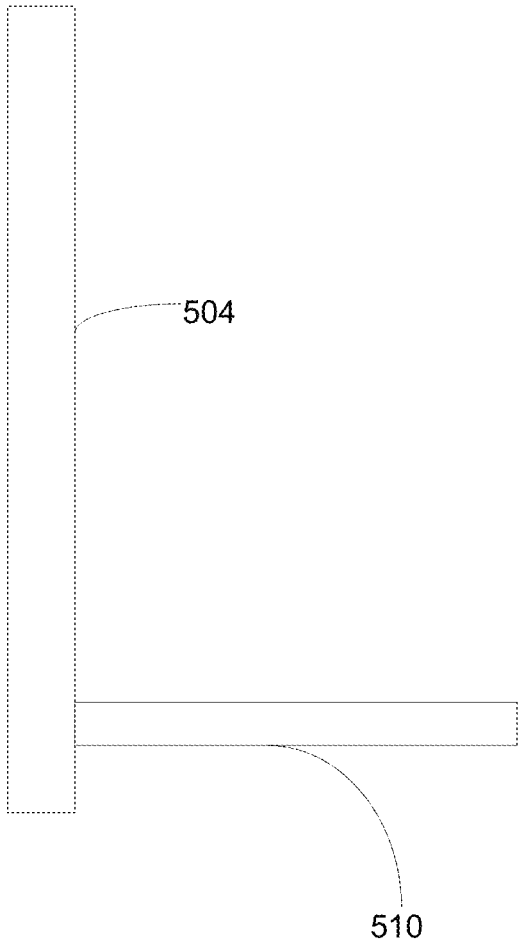
FIG. 8 illustrates a side view of the cam in FIG. 7.
Figure 11:
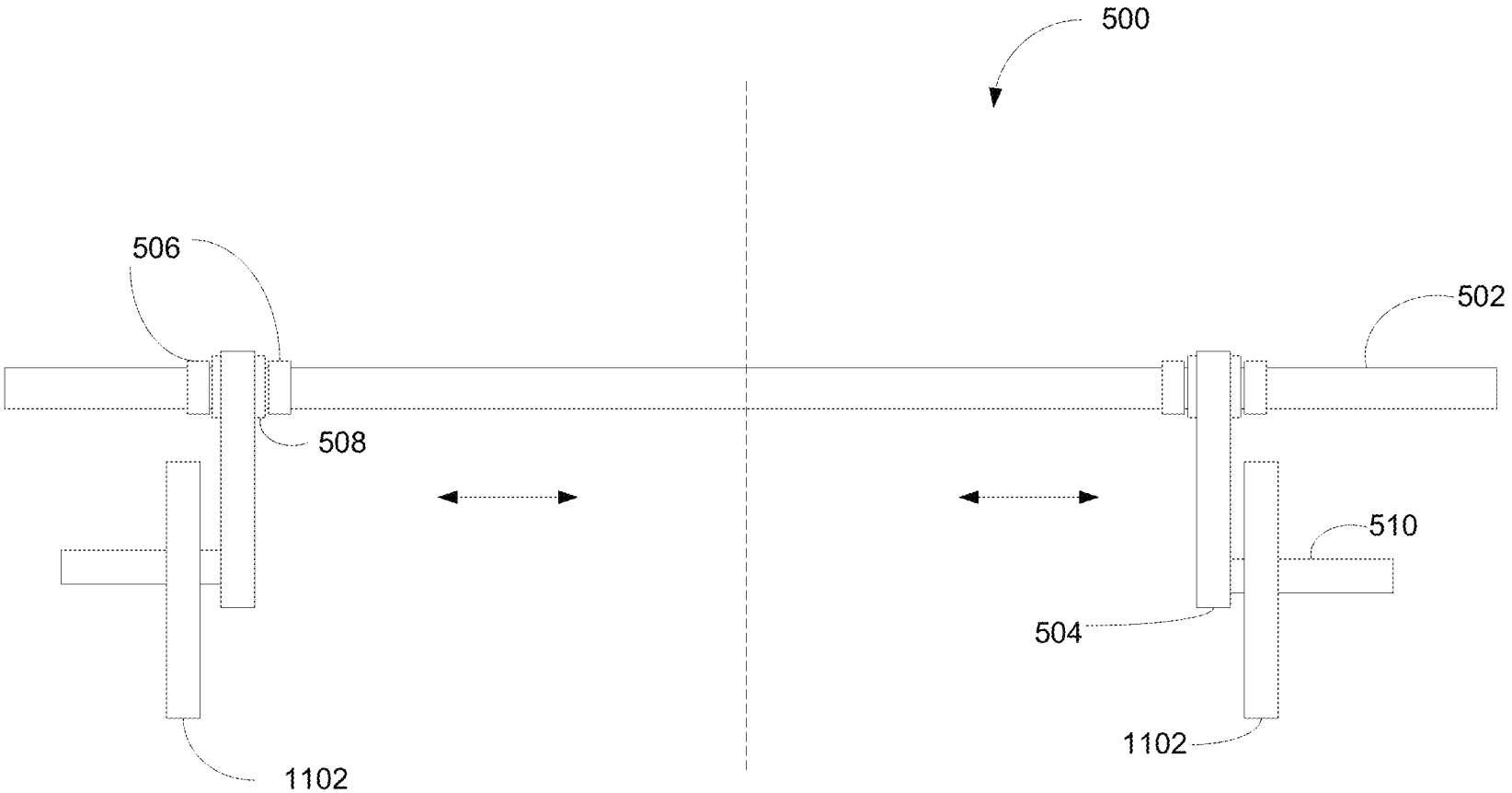
FIG. 11 illustrates a side view of a multi-functional apparatus with weights according to one embodiment of the invention.

Still referring to FIG. 5, the weightlifting bar 502 may be 7 foot long (standard length of most barbells) with 30 mm diameter round bar. In one embodiment, the weightlifting bar 502 may be made from 1144 stress proof steel. In another embodiment, for strength to be able to handle significant weight, the weightlifting bar 502 may be grounded and polished for smooth finish. The set of cams 504 may be dropped down from the weightlifting bar 502 or hung from the weightlifting bar 502. The set of cams 504 includes an opening 702 and a weight loading bar 510 (as shown in FIG. 7). In one embodiment, the material used for the weight loading bar 510 may be the same as the weightlifting bar 502. In another embodiment, the weight loading bar 510 may be about 15.5 inches long. In another embodiment, as shown in FIG. 8, the weight loading bar 510 may be substantially perpendicular to the cam or weight redistribution plate 504. In one embodiment, the weight loading bar 510 fits through the standard opening for free weight plates 1102, as shown in FIG. 11. In this example, the diameter of the weight loading bar 510 is about 2 inches. In other words, the weight loading bar 510 is welded into an opening that is slightly larger than 2 inches, if the weight loading bar 510 and the cam or weight redistribution plate 504 are not constructed as one piece. The welding provides the load bearing capacity to weight loading bar 510.

Figure 9:
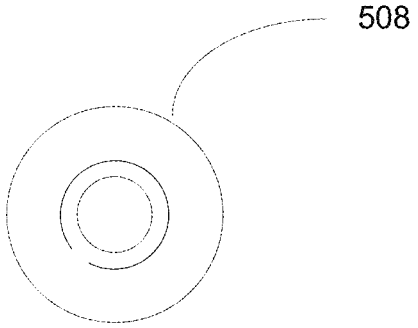
FIG. 9 illustrates a top view of a linear bearing according to one embodiment of the invention.

In one example, the opening 702 of the cam or weight redistribution plate 504 has a size big enough to fit the linear bearing 508. In one embodiment, the linear bearing 508 slides on the weightlifting bar 502. In another embodiment, the linear bearing 508 may be of about 68 mm long with a diameter of about 30 mm inside and an outside diameter of about 47 mm outside pressed into steel tubes. For example, as shown in FIG. 9, an inner diameter of the linear bearing 508 may be slightly bigger than that of the diameter of the weightlifting bar 502 such that the linear bearing 508 may be slidable along the weightlifting bar 502. In another embodiment, the cam or weight redistribution plate 504 and the linear bearing 508 may be constructed as one unit by fitting the linear bearing 508 in the opening 702. In another embodiment, the linear bearing 508 may include a central tube structure with bearings inserted in each end of the tube.

Figure 10:
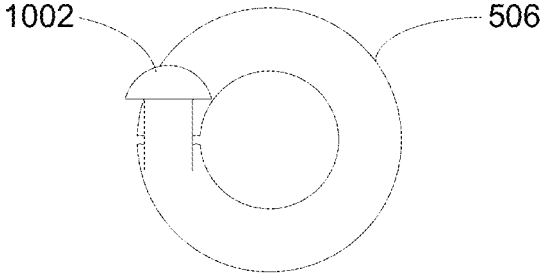
FIG. 10 illustrates a cross-section view of a shaft collar according to one embodiment of the invention.

The apparatus 500 further includes the set of shaft collars 506 to restrict movements of the cam or weight redistribution plate 504. For example, for each of the cams 504 shown in FIG. 5, a set of two shaft collars 506 may be used to prevent the sliding of the cam or weight redistribution plate 504. In one embodiment, the shaft collar 506 includes a locking mechanism 1002, such as a bolt, as shown in FIG. 10, that may be tighten or loosen the grip of the shaft collar 506 on the weightlifting bar 502. In another embodiment, the shaft collar 506 may be incorporated into the linear bearing 508 as one unit. In another embodiment if the linear bearing 508 is incorporated into the cam as one unit, the shaft collar 506 may be further constructed as a part of the cam or weight redistribution plate 504 such that the locking mechanism 1002 on each ends of the opening 702 of the cam 502 may restrict the movements of the cam or weight redistribution plate 504 on the weightlifting bar 502.

In one embodiment, the cam or weight redistribution plate 504 is made of steel and has a length of about 17 inches and a thickness of about 0.5 inches. In one embodiment, the length of the cam or weight redistribution plate 504 is at least 17 inches. It is to be understood that the distance between the weightlifting bar 502 and the cam or weight redistribution plate 504 is at least the radius of the weight plates. In another embodiment, the opening 702 has a diameter of about 47.5 mm. It is to be understood that other shapes for the cam or weight redistribution plate 504 may be modified without departing from the spirit or scope of the invention.

Figure 6:
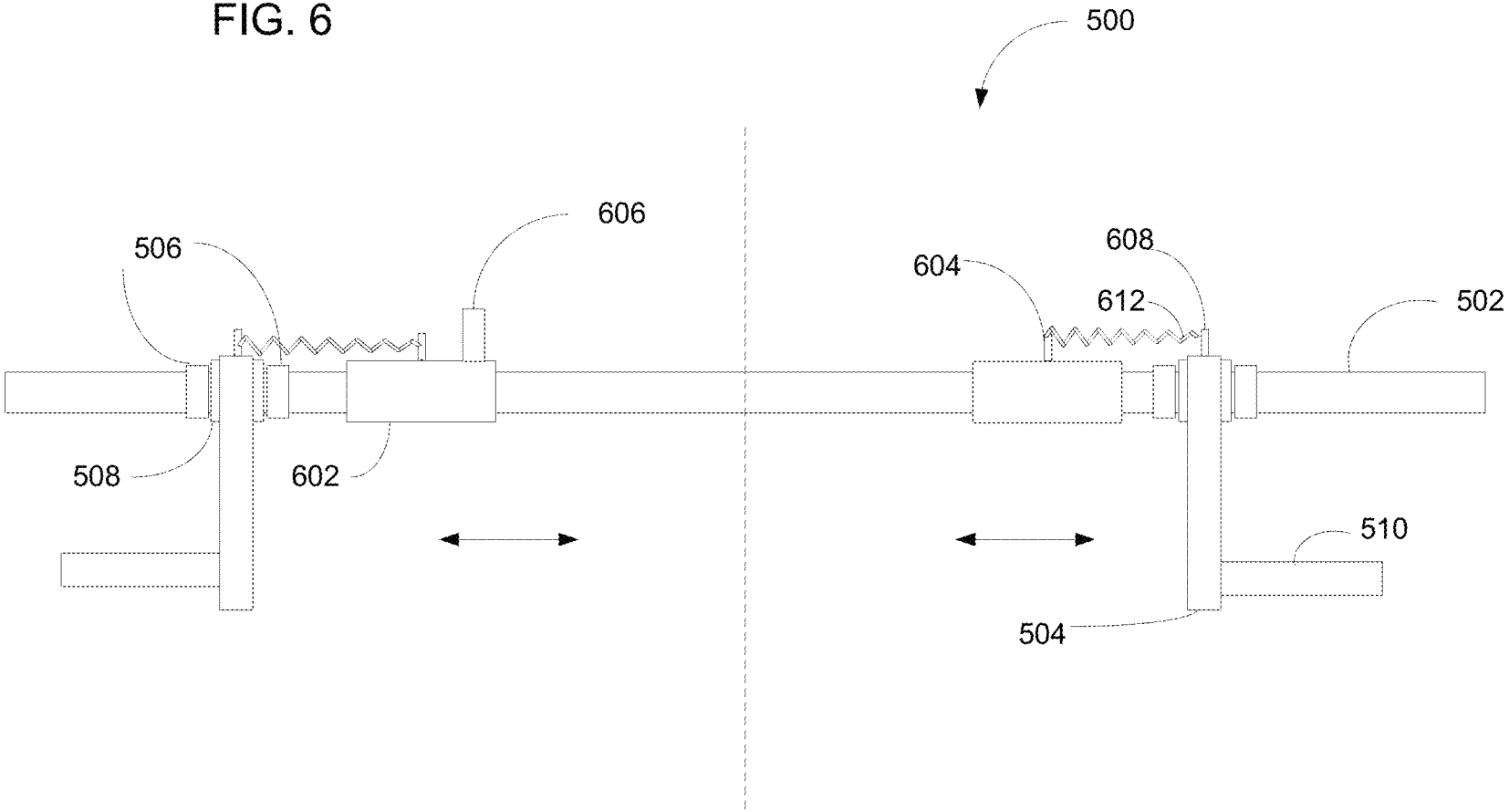
FIG. 6 illustrates a side view of a multi-functional apparatus according to another embodiment of the invention.

Referring now to FIG. 6, a plurality of attachments may be used in connection with the system 500. For example, the cam or weight redistribution plate 504 may include a base connecting point 608. In one embodiment, the base connecting point 608 may be an eye bolt. The base connecting point 608 may be disposed on or near the apex of the cam or weight redistribution plate 504.

Still referring to FIG. 6, an attachment piece 602 may be used to slidably engage with the weightlifting bar 502. In this example, the attachment piece 602 includes a handle 606 and a second connecting point 604. The handle 606 may be padded for easy of grip. The second connecting point 604 may be another eye bolt. The second connecting point 604 further engages with a spring 612. In one example, one end of the spring 612 is engaged with or coupled with the base connecting point 608 and the other end of the spring 612 is engaged with or coupled with the second connecting point 604. As such, a user may exert force by holding on the handle 606 of the attachment piece 602 to slide the attachment piece 606 toward or away from the cam or weight redistribution plate 504 while biasing against the spring 612. The force exerted on the handle 606 becomes another means to exercise the muscle mass near the chest area.

In another embodiment, the attachment piece 602 may be padded, either completely or partially, on its outer surface. In this example, the user may also hold or grip on the padded attachment piece 602 to move toward or away from the cam or weight redistribution plate 504 to the same chest muscle workouts.

It is to be understood that, as seen in FIGS. 5 and 6, in order to insert the attachment piece 602, the user needs to slide the attachment piece 602 from the ends of the weightlifting bar 502 before sliding the shaft collars 506, the linear bearing 508, and the second shaft collar 506. As such, the apparatus 500 provides a great flexibility of the standard weightlifting bar and free weights by allowing the weights to be added or loaded on the weight loading bar 510. The cam or the weight redistribution plate 504 is adjustable or slidable on the weightlifting bar 502. This enables the user to adjust not only the balance easier but also may create different resistance regiment that targets specific muscle groups that normal weight lifting workouts can't achieve.

Aspects of the invention provide an alternative to weightlifters if one is stuck at bottom of lift and cannot get up. As such, embodiments of the invention enable you to simply set it safety on the rack or push the weights off behind you while you move your body forward out of the way. Current implementations of the invention also provide for a better balance of the weight bar while it is on your back, and it also provides the ability to adjust the width of the pads for different size lifters.

Embodiments of the invention further avoid or move away from the use of an exercise machine because the machine takes away the need for "balancing" of muscles. It takes away your body responding and adapting however it needs to, based upon your unique characteristics (flexibility, structure, strengths, weaknesses, etc.). A machine forces every user to the same planes of movement. The user has to adapt to the machine. The machine does not have to adapt to the user.

Figure 12:
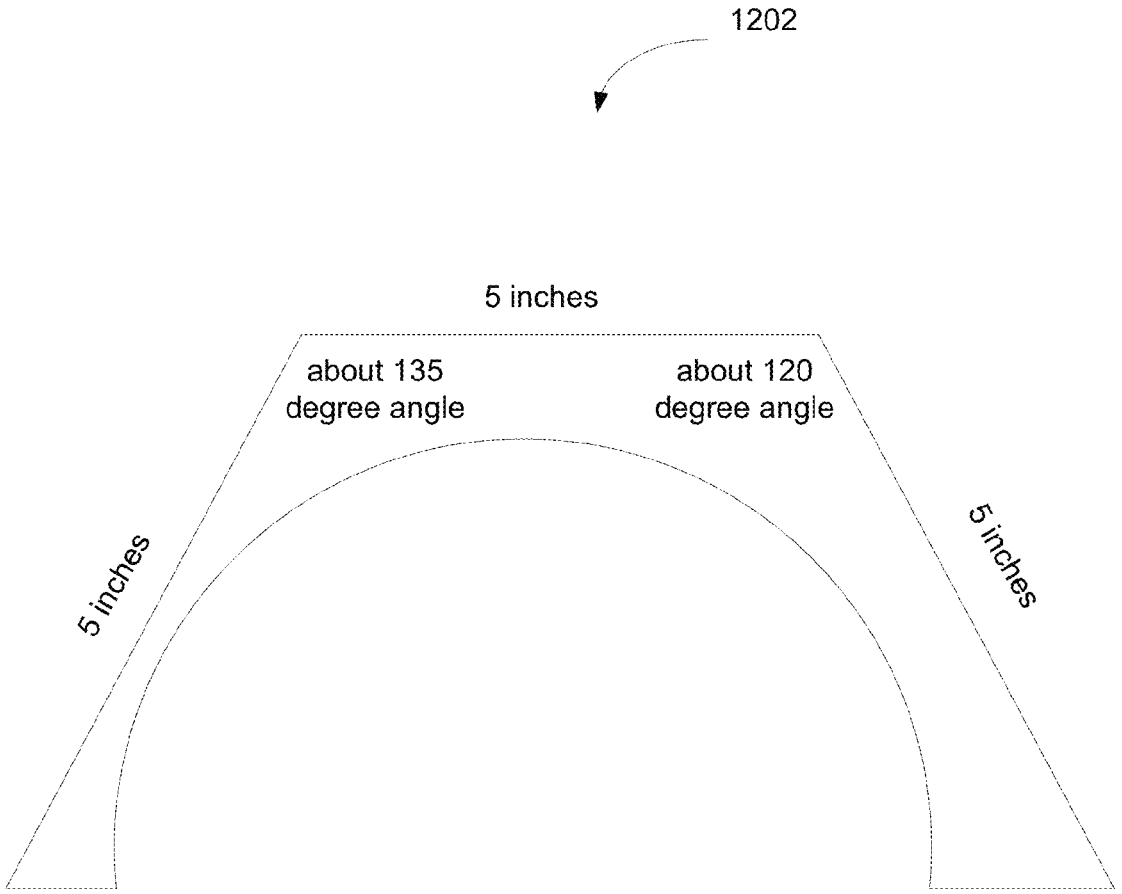
FIG. 12 illustrates a cross-section of a shoulder padding attachment according to one embodiment of the invention.

In one embodiment, one attachment that may be used with the weightlifting bar 502 is a shoulder padding or a "over the shoulder device," should as the shoulder padding 1202 shown in FIG. 12. This is an attempt to lessen the discomfort that comes with squatting. For example, it is not as big of an issue for weightlifters who have developed the trapezius muscles between the base of their neck and the tops of their shoulders. These muscles, for those folks, can act as a "table" that the weight can sit on. A more developed trapezius muscle helps alleviate some of the discomfort. But for the majority of people who don't have the muscle in that area, the shoulder padding comes in a shape of an open trapezoid shape or a reverse cup shape such that the shoulders fit into the padding.

According to another embodiment, the weight plates hanging off the cam or weight redistribution plate 504 make the squat feel a little different. It had to do with a lower center of gravity.

In one example, the attachment piece 602 may be of about 12 inch pieces in length and may be made of steel tubing with an outside diameter of about two inches and inside diameter of about 47 mm. People have been able to squat for leg muscle development for years using the traditional bar in the traditional way and have been able to bench press for years using the traditional bar in the traditional way, as shown in the prior art. However, aspects of the invention enable these individuals to weightlift while reducing discomfort while squatting, or enable individuals who are interested in the improved balance that aspects of the invention provide or interested in the added stress/muscle activation put on the chest muscles while bench pressing.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that the several objects of the invention are achieved and other advantageous results attained.

As various changes could be made in the above apparatuses and methods without departing from the scope of the invention, it is intended that all matter contained in the above description and shown in the accompanying drawings shall be interpreted as illustrative and not in a limiting sense.

What is claimed is:

1. An apparatus comprising:

a weightlifting bar having a longitudinal direction;

a set of cams each having an opening and a weight loading bar extending therefrom and being substantially perpendicular to the set of cams, wherein each cam of the set of cams is suspended from the weightlifting bar;

a slidable linear bearing for engaging with the weightlifting bar, said linear bearing being fitted in the opening of each of the set of cams and being capable of sliding along the longitudinal direction of the weightlifting bar;

a set of shaft collars for securing the linear bearing in a position on the weightlifting bar between the set of shaft collars, and two handles disposed annularly on the weightlifting bar capable of reciprocally sliding along the longitudinal direction of the weightlifting bar, each of the handles being capable during use of sliding toward or away from an adjacent cam;

wherein each of the set of cams further comprises a base connecting point for attaching a spring thereto.

2. The apparatus of claim 1, further comprising an attachment piece slidably engaging with the weightlifting bar, said attachment piece including a second connecting point for connecting with the spring, wherein the attachment piece is slidable longitudinally along the weightlifting bar in response to a force biasing against the spring.

3. The apparatus of claim 1, wherein the slidable linear bearing engages with the weightlifting bar along an entire length thereof, wherein said length of the weightlifting bar includes discrete positions of the set of shaft collars.

4. The apparatus of claim 3, wherein each of the set of shaft collars further comprises a securing device to restrict movement of the each of the set of shaft collars on the weightlifting bar at said discrete positions.

5. A system for weightlifting comprising:

a weightlifting bar having a longitudinal direction;

a set of weight distribution plates each having an opening and a weight loading bar protruding therefrom;

a linear bearing annularly disposed on the weightlifting bar capable of sliding along the longitudinal direction of the weightlifting bar; and each of the set of weight distribution plates further comprising a first base connecting point for attaching a spring and an attachment piece slidably engaging with the weightlifting bar at the first connecting point, said attachment piece including a second connecting point for connecting with the spring, wherein the attachment piece is reciprocally slidable toward or away from an adjacent weight distribution plate along the weightlifting bar in response to force biasing against the spring;

wherein each of the set of weight distribution plates includes a set of shaft collars on either end of the set of weight distribution plates for securing the linear bearing in a position on the weightlifting bar between the set of shaft collars.

6. The system for weightlifting of claim 5, wherein the weight loading bar is substantially perpendicular to each of the set of weight distribution plates.

7. The system for weightlifting of claim 5, wherein each of the set of weight distribution plates further comprises a slidable linear bearing, said slidable linear bearing being fitted in the opening of the each of the set of weight distribution plates for engaging with the weightlifting bar.

8. The system for weightlifting of claim 7, wherein the linear bearing slidably engages with the weightlifting bar along an entire length thereof, subject to positions of the set of shaft collars.

9. The system for weightlifting of claim 5, wherein each of the set of shaft collars comprises a securing device to restrict movements of the each of the set of shaft collars on the weightlifting bar.

10. A slidable weight distribution device comprising:

a cam having an opening and a weight loading bar protruding therefrom, said cam slidably engaging with a weightlifting bar and being capable of sliding along a longitudinal direction of the weightlifting bar;

a set of shaft collars for securing the cam in a position on the weightlifting bar between the set of shaft collars; and two handles disposed annularly on the weightlifting bar capable of reciprocally sliding along the longitudinal direction of the weightlifting bar, each of the handles being capable during use of sliding toward or away from an adjacent cam;

wherein the cam further comprises a base connecting point for attaching a sprinsg thereto.

11. The slidable weight distribution device of claim 10, wherein the weight loading bar is substantially parallel to the weightlifting bar.

12. The slidable weight distribution device of claim 10, wherein the cam further comprises a slidable linear bearing, said linear bearing being fitted in the opening of the cam for engaging with the weightlifting bar.

* * * * *